US005537337A

United States Patent [19]

Williams

[11] Patent Number: 5,537,337

[45] Date of Patent: Jul. 16, 1996

[54] PLAYBACK CONFLICT DETECTION METHOD AND APPARATUS

[75] Inventor: Marvin L. Williams, Lewisville, Tex.

[73] Assignee: International Business Machines Corporation, Armonk, N.Y.

[21] Appl. No.: 172,687

[22] Filed: Dec. 21, 1993

[51] Int. Cl.[6] ..... G04F 5/00

[52] U.S. Cl. ..... 364/514 R; 364/569; 395/154; 395/550; 395/155

[58] Field of Search ..... 364/569, 514, 364/514 A, 514 B, 514 C, 514 R; 395/154, 155, 550, 161, 158, 160, 153; 375/112, 113, 117, 118, 116, 107, 109, 120; 371/1, 2.1, 5.4, 61, 62; 370/84, 95.3, 100.1, 101, 103, 110.1, 47, 48; 369/60, 19, 44.25, 44.31, 44.33, 44.38, 39, 47, 53, 84, 132; 345/1, 115

[56] References Cited

U.S. PATENT DOCUMENTS

| | | | |
|---|---|---|---|
| 4,807,154 | 2/1989 | Scully et al. | 395/161 |
| 4,807,155 | 2/1989 | Cree et al. | 345/1 |
| 4,817,018 | 3/1989 | Cree et al. | 395/155 |
| 4,866,611 | 9/1989 | Cree et al. | 364/947.2 |
| 4,872,073 | 10/1989 | Fincher et al. | 370/101 |
| 5,129,057 | 7/1992 | Strope et al. | 395/161 |
| 5,233,545 | 8/1993 | Ho et al. | 364/569 |
| 5,249,291 | 9/1993 | Williams et al. | 395/650 |
| 5,307,456 | 4/1994 | Machay | 395/154 |
| 5,333,299 | 7/1994 | Koval et al. | 370/100.1 |
| 5,371,551 | 12/1994 | Logan et al. | 369/60 |
| 5,392,390 | 2/1995 | Crozier | 395/161 |
| 5,438,658 | 8/1995 | Fitzpatrick et al. | 395/153 |
| 5,448,731 | 9/1995 | Wang et al. | 395/650 |

FOREIGN PATENT DOCUMENTS

| | | |
|---|---|---|
| 0447341A2 | 2/1991 | European Pat. Off. . |
| 0491642A2 | 10/1991 | European Pat. Off. . |
| 0597796A2 | 10/1993 | European Pat. Off. . |

OTHER PUBLICATIONS

G P Fitzpatrick, B K Jackson and M L Williams "An Electronic Calendar Communications Device" Research Disclosure, No. 334, publ. Feb. 1992.

J P Vincent "Electronic Due Dates" IBM Technical Disclosure Bulletin, vol. 32, No. 9B, pp. 345–347, publ. Feb. 1990.

J P Vincent "Accepting Due Dates from the Mail" IBM Technical Disclosure Bulleting, vol. 32, No. 9B, pp. 349, publ. Feb. 1990.

J P Vincent "Using Footnotes to Show Conflicting Meetings on Printed Calendars" IBM Technical Disclosure Bulletin, vol. 31, No. 4, pp. 127–128, publ. Sep. 1988.

S A Kelley and M E Weidmann "Signal Overlapping Meeting Times" IBM Technical Disclosure Bulletin, vol. 29, No. 4, pp. 1603, publ. Sep. 1986.

*Primary Examiner*—Ellis B. Ramirez
*Assistant Examiner*—Hal D. Wachsman
*Attorney, Agent, or Firm*—Norman L. Gundel

[57] ABSTRACT

A method and apparatus are provided for playback conflict detection. In one embodiment, the invention determines a time interval for the playback of the isosynchronous data object, said time interval including both a beginning time and a duration, and determines whether any calendar event falls at least partially within the time interval for playback. The invention may be initiated by opening the isosynchronous data object for playback. The user who requested the playback will be notified of any potential conflict between the complete playback of the data object and any events scheduled on the user's electronic calendar.

18 Claims, 4 Drawing Sheets

PLAYBACK CONFLICT DETECTION METHOD AND APPARATUS

BACKGROUND OF THE INVENTION

1. Field of the Invention

The present invention relates to a data processing system capable of playing multimedia presentations and relates more particularly to a data processing system that warns a user that the complete playback of a multimedia presentation will conflict with an upcoming calendar event.

2. Description of the Related Art

A data processing system may be capable of playing back, or displaying, multimedia presentations that may contain motion video or audio data. Such multimedia presentations are isosynchronous in nature; that is, timing characteristics are the basis for conveying information. For example, motion video may be optimally presented by presenting individual video frames in a particular order and at a particular rate of frames per unit of time. Similarly, audio, such as recorded or synthesized speech and recorded or synthesized music, may be optimally presented at a particular rate. Such multimedia presentations may be contrasted with, for example, graphical data or, ordinarily, textual information, whose rate of presentation to a human user of the data processing system is not normally significant. Under certain circumstances, however, even text can be considered isosynchronous, as where a text-to-speech process is used to convert the text to spoken audio speech. Similarly, if the text is presented to the user by scrolling it across a display screen, the scrolling rate, which may be measured in characters or in lines per unit of time, give the presentation of the text isosynchronous properties.

The optimal rate of presentation of the information in an object that contains isosynchronous data gives that object an optimal playback duration, which may be expressed in time. Some multimedia objects expressly state their duration; for example, the directory structure of audio compact discs may state the time duration of individual tracks. An isosynchronous data object differs in this manner from a non-isosynchronous data object such as a graphical image file—while both objects typically have a file size, which may be expressed in bytes, only the isosynchronous object also has a time duration, which may be expressed in seconds, minutes or hours or the like.

A data processing system may include an electronic calendar application which allows the user to maintain a schedule of upcoming events of interest to him. Calendar events may have a start time, a stop time and a duration. When adding a new event to a calendar, the calendar application may check the existing calendar events for any events that conflict in time with the event to be added. However, data processing systems, even those that include calendar applications, do not notify a user that a scheduled calendar event will conflict with the complete playback of an isosynchronous data object. Thus, there is a need for a data processing system that notifies a user that a scheduled calendar event will conflict with the complete playback of an isosynchronous data object.

SUMMARY OF THE INVENTION

In accordance with the invention, a method and apparatus are provided for playback conflict detection. In one embodiment, the invention determines a time interval for the playback of the isosynchronous data object, said time interval including both a beginning time and a duration, and determines whether any calendar event falls at least partially within the time interval for playback. The invention may be initiated by opening the isosynchronous data object for playback. The user who requested the playback will be notified of any potential conflict between the complete playback of the data object and any events scheduled on the user's electronic calendar.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative detailed embodiment when read in conjunction with the accompanying drawings, wherein:

While the invention will be described in connection with a preferred embodiment, it will be understood that the description is not intended to limit the invention to that embodiment. On the contrary, the invention is intended to cover all alternatives, modifications and equivalents as may be included within the spirit and scope of the invention as described by the appended claims.

DETAILED DESCRIPTION OF THE PREFERRED EMBODIMENT

Figure 1:
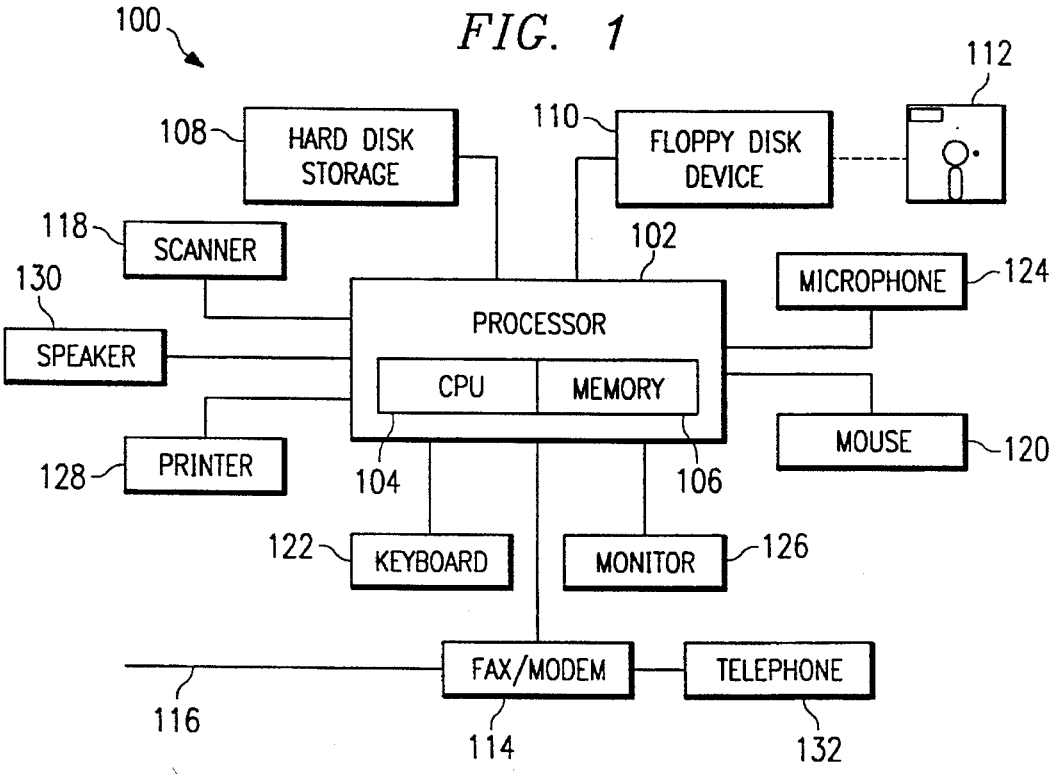
FIG. 1 is a block diagram of an apparatus used in performing the method of a preferred embodiment of the present invention and forming a part of the apparatus of a preferred embodiment of the present invention.

With reference now to the Figures, and in particular with reference to FIG. 1, there is shown, in block diagram form, an apparatus according to the present invention. The apparatus includes a data processing system 100. The data processing system 100 includes a processor 102, which includes a central processing unit (CPU) 104 and memory 106. Additional memory, such as a hard disk file storage 108 and a floppy disk device 110 may be connected to the processor 102. Floppy disk device 110 may write to or read from a removable diskette 112 which may have computer program code recorded thereon that implements portions of the present invention in the data processing system 100. Inputs may also be received from a fax/modem 114, which is connected to a telephone line 116, and from a microphone 124. The data processing system 100 also includes user interface hardware, such as a mouse 120, a keyboard 122 and a scanner 118, for allowing user input to the processor 102. The data processing system 100 also includes visual display devices, such as a monochrome or color display monitor 126 and a monochrome or color display printer 128, for rendering visual information. The data processing system may also include an audio display device, such as a speaker 130 for rendering audio information. A telephone 132 may be connected to the telephone line 116 through the fax/modem 114.

Figure 2:
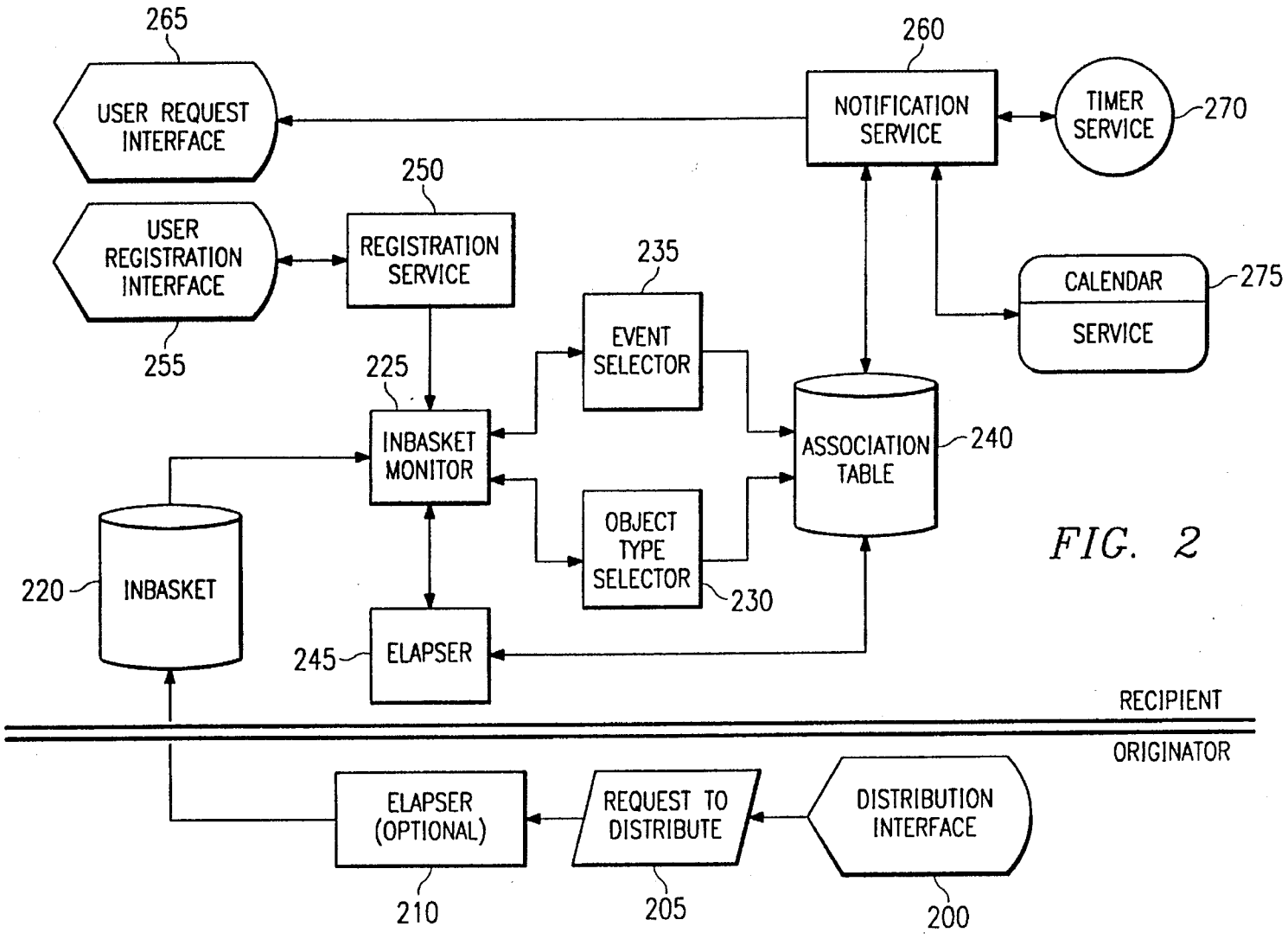
FIG. 2 is a block diagram illustrating the method of a preferred embodiment of the present invention.

With reference now to FIG. 2, there is depicted a block diagram which illustrates the method of a preferred embodiment of the present invention for playback conflict detection and resolution. The process begins at block 200 upon the initiation of the sending of an isosynchronous data object by a human user called a sender. The data processing system presents the sender with a distribution interface that offers the sender the option of assigning a time duration to the isosynchronous data object. After the option is accepted or rejected, the process proceeds to block 205 and processes the sender's request to distribute the object to one or more recipients, as specified by the sender. The process then proceeds to optional block 210, where an elapser of the data processing system determines the time duration of the isosynchronous data object.

The elapser of block 210 may use different processes to determine the time duration necessary for the object to be completely conveyed. The elapser may playback the object and measure the elapsed time required. It may compute the duration of a motion video object by applying the frame display rate to the number of frames of the object, which number may be either supplied by the object or counted by the elapser. It may estimate the duration of a text object by applying a specified transfer rate to the number of words or even the number of bytes, if the text is to be converted to speech or visually displayed by scrolling. The elapser of block 210 associates the time duration to the isosynchronous data object before forwarding it to the specified recipients, unless a time duration is already associated to the object, as by block 200 above, or unless the use of an elapser is not offered or elected during the sending process.

The process now proceeds to block 220, which, together with the remainder of FIG. 2, illustrates the process as it operates on behalf of the recipient of the isosynchronous data object. The object is received in the recipient's inbasket, block 220, where it is monitored by the inbasket monitor, block 225. The inbasket monitor analyzes incoming objects to ascertain whether the incoming objects should be checked for playback conflict detection. The inbasket monitor checks the types of incoming objects to determine whether they are isosynchronous object types such as motion video or audio, as illustrated by block 230. All isosynchronous object types will be registered with association table 240.

The inbasket monitor also checks other, user configurable characteristics of incoming objects that are determined to be isosynchronous, as illustrated by event selector block 235. These characteristics determine whether an isosynchronous object to be registered in the association table 240 will be marked for conflict resolution or not. Such characteristics monitored may include the sender's identity, keywords in the object's subject field, abstract or body, or the object's classification as "important," "urgent," "personal," "private," or the like.

Incoming objects that meet the inbasket monitor's criteria create event record entries in the association table 240. Each record contains a pointer to the incoming object in the inbasket and the time duration of the object. The time duration may be derived from that associated with the object during the send process of blocks 200–210, if present. Alternatively, the time duration may be derived by an elapser 245, which is similar to elapser 210 described above. Elapser 245 may optionally be used to modify or confirm a duration previously associated with an isosynchronous data object, or to conform the duration to differing user display rate preferences or to different data processing system hardware display rate capabilities.

Registration service 250 is also provided to permit user configuration of the operation of the inbasket monitor 225, as described above, through the use of user registration interface 255. The user may configure the object types to be monitored, as illustrated by block 235 above, for example choosing to include text objects for scrolling display or text-to-speech conversion. The user may also optionally enter object classifications or keywords to be monitored, as illustrated by block 230 above. The user may also configure the elapser 245 to enable calculation of durations from application of estimated display rates to incoming objects, or alternatively, require that such objects be played and their playing times measured, called preplaying.

Notification service 260 is activated by user input to the user interface 265, as by the opening of an inbasket item for display to the user. Upon the user's specification of the inbasket item to be opened, the notification service 260 checks the association table 240 to determine whether that object is registered in the association table 240. If so, the process accesses the calendar service 275 so as to have access to the user's calendar events. The process then returns to the association table 240 to determine whether the object is of the event type registered for conflict. If so, the process retrieves the object's duration from the association table 240, retrieves the current time from timer service 270, and compares them to the user's calendar events of calendar service 275 to determine whether the immediate playback of the isosynchronous data object will present a conflict with a scheduled calendar event on the user's calendar. If so, the process notifies the user of the conflict through user interface 265 and allows the user to abort the playback of the isosynchronous data object. If the playback is aborted, the process terminates; otherwise, the process returns control of the playback to the data processing system's normal inbasket services.

Figure 3:
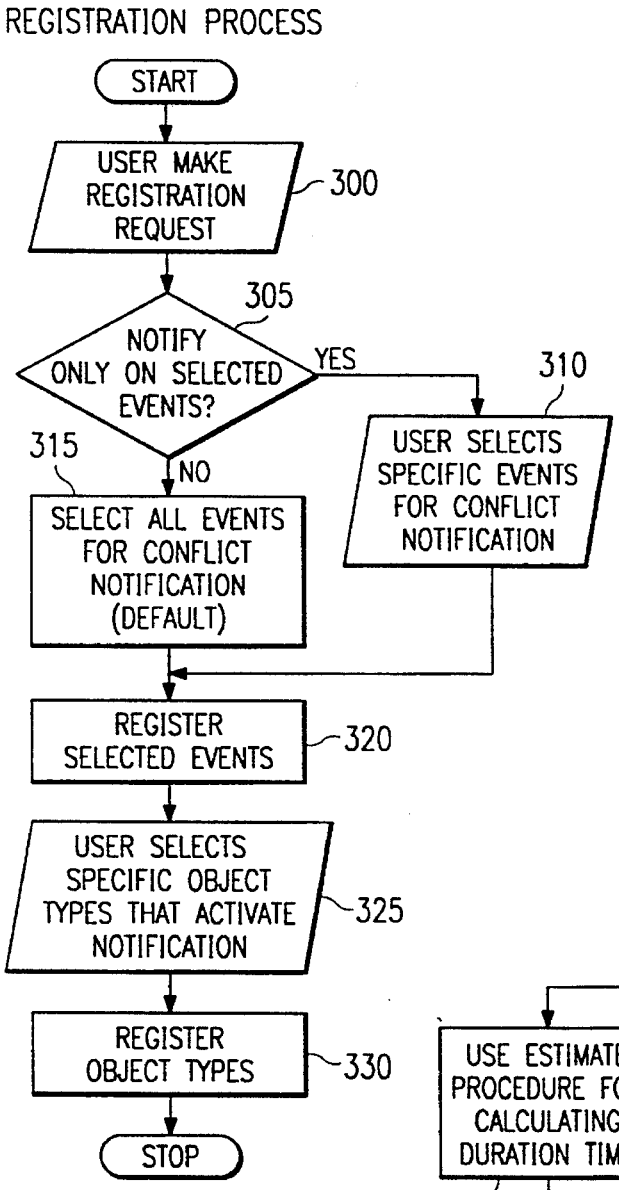
FIG. 3 is a high level logic flowchart illustrating the registration process of the preferred embodiment of the method of the present invention.

Turning now to FIG. 3, there is shown a high level flowchart of the registration pro(less illustrated by blocks 250 and 255 of FIG. 2. The registration process commences at block 300 when the user makes a registration request. The process proceeds to block 305 for input of whether the process should notify the user of conflicts only for certain selected event types. If so, the process proceeds to block 310 for the input of specific events for conflict notification. As discussed above, such events may include the existence, in an isosynchronous data object, of characteristics such as the sender's identity, keywords in the object's subject field, abstract or body, or the object's classification as "important," "urgent," "personal," "private," or the like.

After the input of such characteristics, the process proceeds to block 320 and registers such characteristics as events requiring conflict resolution. Returning to block 310, if conflict notification only upon selected events is not elected, the process proceeds to block 315 and selects all events for conflict notification.

The process proceeds from block 320 to block 325 for the input of specific object types that activate notification. This permits the user to specify whether certain object types, such as text objects, shall be treated as isosynchronous. Text objects may be isosynchronous if they are displayed to the user by scrolling or by text-to-speech conversion, whereas a text object to be printed would not ordinarily be treated as isosynchronous. The registration process then proceeds to block 330 to register the object types, and then terminates.

Figure 4:
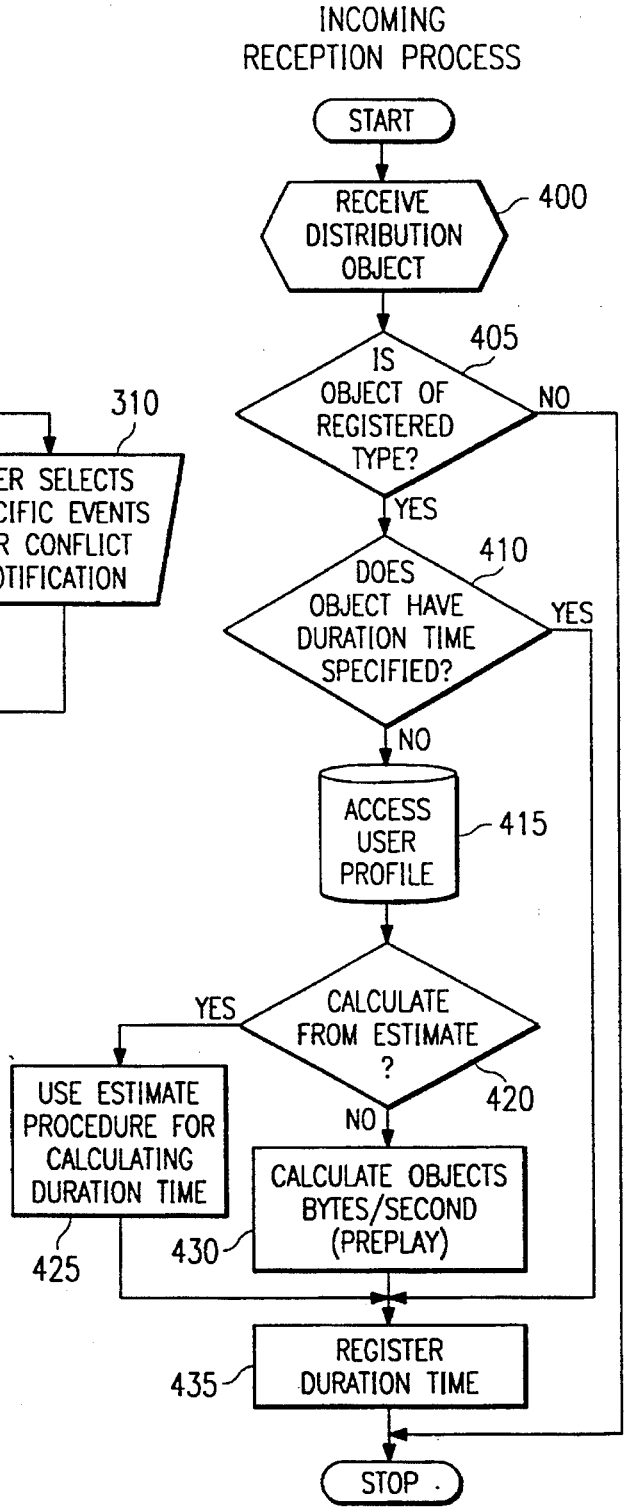
FIG. 4 is a high level logic flowchart illustrating the incoming reception process of the preferred embodiment of the method of the present invention.

Turning next to FIG. 4, there is shown a high level flowchart of the incoming reception process illustrated by blocks 220 through 245 of FIG. 2. This process begins at block 400 upon the receipt of a data object by inbasket 220. The process then proceeds to block 405 for a determination of whether the object is of a registered type and characteristic. If not, the process terminates. If so, the process proceeds to block 410 for a determination of whether the object has a duration time already specified. If not, the process proceeds to block 415, accesses the user profile, and proceeds to block 420 for a determination of whether the user profile permits calculation of duration from an estimate.

If calculation of a duration from an estimate is permitted, the process retrieves a display rate from the user profile and applies it to a length of the isosynchronous data object, such as the number of frames of a motion video object, to compute a duration. The process then proceeds to block 435 to register the duration time in the association table 240, and then terminates.

Returning to block 420, if calculation of duration from estimate is not permitted, the process preplays the isosynchronous data object and measures its actual duration. The process then proceeds to block 435, records the actual duration in the association table, and terminates.

Returning to block 410, if the isosynchronous data object already has a duration time specified, the process proceeds from block 410 to block 435 and records the specified duration time in the association table and then terminates.

Figure 5:
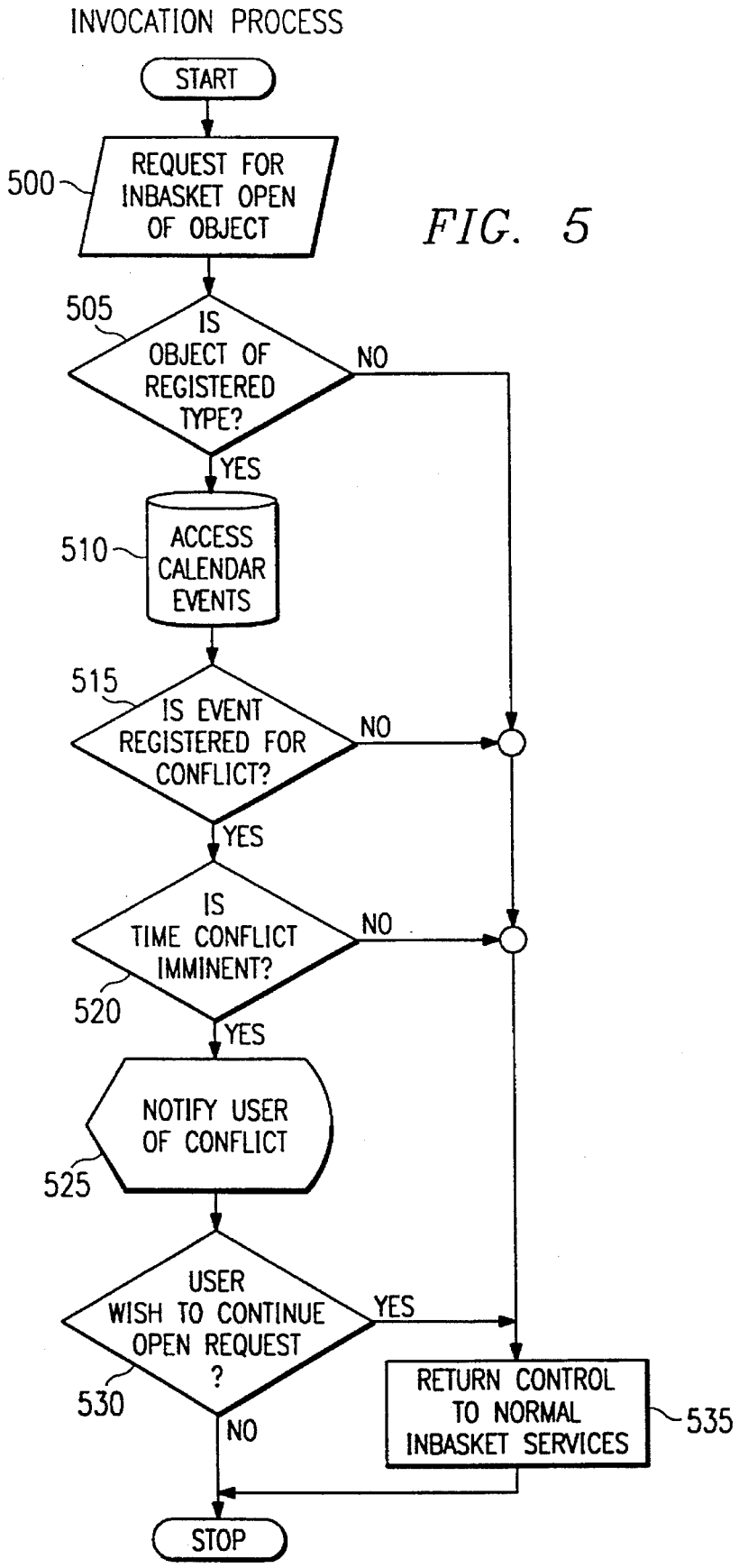
FIG. 5 is a high level logic flowchart illustrating the invocation process of the preferred embodiment of the method of the present invention.

Turning next to FIG. 5, there is shown a high level flowchart of the invocation process illustrated by blocks 260 through 275 of FIG. 2. The process commences at block 500 upon the data processing system's receipt of a request from a user to open an object in the user's inbasket for display to the user. The process then proceeds to block 505 for a determination of whether the inbasket object is registered in the association table 240 as an isosynchronous type. If yes, the process proceeds to block 510 and accesses the calendar service to access the user's calendar events. The process then proceeds to block 515 for a determination of whether the inbasket object has an event characteristic registered for conflict. If yes, the process proceeds to block 520, accesses the present time from the timer service 270, and, using the isosynchronous data object's duration from the association table 240, determines whether the user's calendar events accessed in block 510 above present an imminent time conflict.

Stated otherwise, the process determines at block 520 whether the playback duration of the isosynchronous data event, beginning at the current: time, will overlap or present a conflict with any calendar event on the user's calendar. If a conflict is detected, the process proceeds to block 525, notifies the user of the conflict, proceeds to block 530 and determines whether the user still wishes to open the isosynchronous data object for immediate playback. If not, the process terminates. If so, the process proceeds to block 535 and returns control of the playback request to the normal inbasket display service of the data processing system. The process then terminates.

Returning to block 505, if the object is not a registered isosynchronous data type, the process proceeds to block 535 and returns control of the playback request to the normal inbasket display service of the data processing system. The process then terminates.

Returning to block 515, if the object is not a registered event type for conflict resolution, the process proceeds to block 535 and returns control of the playback request to the normal inbasket display service of the data processing system. The process then terminates.

Returning to block 520, if no imminent conflict is detected, the process proceeds to block 535 and returns control of the playback request to the normal inbasket display service of the data processing system. The process then terminates.

While the invention has been particularly shown and described with reference to a preferred embodiment and process, it will be understood that various changes in form and detail may be made therein without departing from the spirit and scope of the invention.

What is claimed is:

1. A method, performed in a data processing system that includes an electronic calendar having an owner, for detecting a conflict between playback of an isosynchronous data object and a conflicting calendar event of the electronic calendar, the method comprising the computer implemented steps of:

determining a time interval for playback of the isosynchronous data object, said time interval including both a beginning time and a duration;

determining whether a conflicting calendar event falls at least partially within the time interval for playback; and notifying the owner of the electronic calendar containing the conflicting calendar event that a conflicting calendar event falls at least partially within the time interval for playback.

2. The method of claim 1, wherein the step of determining whether a conflicting calendar event falls at least partially within the time interval for playback is initiated in response to a request to playback the isosynchronous data object and the beginning time is the time of the request.

3. The method of claim 1, wherein the step of determining whether a conflicting calendar event falls at least partially within the time interval for playback is initiated in response to a user-initiated request, received from the owner of the electronic calendar containing the conflicting calendar event, to playback the isosynchronous data object.

4. The method of claim 3, wherein the method further comprises the computer implemented step of accessing an electronic calendar of the user initiating the request to playback.

5. The method of claim 1, further comprising the computer implemented step of determining the duration by preplaying the isosynchronous data object.

6. The method of claim 1, further comprising the computer implemented step of determining the duration by applying a display rate to the isosynchronous data object.

7. A data processing system for detecting a conflict between playback of an isosynchronous data object and a conflicting calendar event of an electronic calendar, comprising:

an electronic calendar having an owner;

means for determining a time interval for playback of the isosynchronous data object, said time interval including both a beginning time and a duration;

means for determining whether a conflicting calendar event of the electronic calendar falls at least partially within the time interval for playback; and means for notifying the owner of the electronic calendar containing the conflicting calendar event that a conflicting calendar event falls at least partially within the time interval for playback.

8. The data processing system of claim 7, wherein the means for determining whether a conflicting calendar event of the electronic calendar falls at least partially within the time interval for playback is responsive to a request to playback the isosynchronous data object and the beginning time is the time of the request.

9. The data processing system of claim 7, wherein the means for determining whether a conflicting calendar event of the electronic calendar falls at least partially within the time interval for playback is responsive to a user-initiated request, received from the owner of the electronic calendar containing the conflicting calendar event, to playback the isosynchronous data object.

10. The data processing system of claim 9, wherein the data processing system further comprises means for accessing an electronic calendar of the user initiating the request to playback.

11. The data processing system of claim 7, further comprising means for determining the duration by preplaying the isosynchronous data object.

12. The data processing system of claim 7, further comprising means for determining the duration by applying a display rate to the isosynchronous data object.

13. A computer program product, for use in a data processing system, for detecting a conflict between playback of an isosynchronous data object and a conflicting calendar event of an electronic calendar, said data processing system including an electronic calendar having an owner, the computer program product comprising:

a computer usable storage medium having computer readable program code embodied in said storage medium for granting access to the data processing system, said computer program product including:

computer readable program code means for determining a time interval for playback of the isosynchronous data object, said time interval including both a beginning time and a duration;

computer readable program code means for determining whether a conflicting calendar event of the electronic calendar falls at least partially within the time interval for playback; and computer readable program code means for notifying the owner of the electronic calendar containing the conflicting calendar event that a conflicting calendar event falls at least partially within the time interval for playback.

14. The computer program product of claim 13, wherein the computer readable program code means for determining whether a conflicting calendar event of the electronic calendar falls at least partially within the time interval for playback is responsive to a request to playback the isosynchronous data object and the beginning time is the time of the request.

15. The computer program product of claim 13, wherein the computer readable program code means for determining whether a conflicting calendar event of the electronic calendar falls at least partially within the time interval for playback is responsive to a user-initiated request, received from the owner of the electronic calendar containing the conflicting calendar event, to playback the isosynchronous data object.

16. The computer program product of claim 15, wherein the data processing system further comprises means for accessing an electronic calendar of the user initiating the request to playback.

17. The computer program product of claim 13, further comprising computer readable program code means for determining the duration by preplaying the isosynchronous data object.

18. The computer program product of claim 13, further comprising computer readable program code means for determining the duration by applying a display rate to the isosynchronous data object.

* * * * *